United States Patent [19]

LaNieve

[11] 4,015,924

[45] Apr. 5, 1977

[54] SPINNING APPARATUS PROVIDING FOR ESSENTIALLY CONSTANT EXTENSIONAL STRAIN RATE

[75] Inventor: Herman L. LaNieve, Summit, N.J.

[73] Assignee: Celanese Corporation, New York, N.Y.

[22] Filed: July 8, 1975

[21] Appl. No.: 594,010

Related U.S. Application Data

[62] Division of Ser. No. 387,407, Aug. 10, 1973, Pat. No. 3,925,525.

[52] U.S. Cl. ..... 425/455 F; 425/461

[51] Int. Cl.[2] ..... D01D 3/00

[58] Field of Search ..... 425/461, 464, 455 F; 264/177 F, 176 F

[56] References Cited

UNITED STATES PATENTS

| | | | |
|---|---|---|---|
| 2,879,676 | 3/1959 | Burkhardt et al. | 425/461 X |
| 3,210,451 | 10/1965 | Manning et al. | 425/464 X |
| 3,382,535 | 5/1968 | Farrari | 425/461 |

*Primary Examiner*—Robert D. Baldwin

[57] ABSTRACT

Liquid polymeric materials, in a fiber spinning operation, are extruded through extrusion passageways of a spinneret plate. The passageways are designed to establish an essentially constant extensional strain rate condition for flow of liquid. The profile of the passageways is described essentially by the equation $$\frac{1}{\gamma_w 2} = AZ + \frac{1}{R^2}$$

where:

$R$ is the perpendicular distance between an axis of the passageway axis and the nozzle wall at the exit orifice;

$r_w$ is the perpendicular distance between nozzle wall and points along that axis;

$Z$ is the distance along that axis measured from said exit orifice; and $A$ is a constant.

13 Claims, 5 Drawing Figures

SPINNING APPARATUS PROVIDING FOR ESSENTIALLY CONSTANT EXTENSIONAL STRAIN RATE

This is a division of application Ser. No. 387,407, filed Aug. 10, 1973, and issued as U.S. Pat. No. 3,925,525 on Dec. 9, 1975.

BACKGROUND AND OBJECTS OF THE INVENTION

This invention relates to the spinning of synthetic filaments. More particularly, this invention relates to a novel apparatus for the spinning of synthetic filaments utilizing a spinneret nozzel designed to establish an essentially constant extensional strain rate.

In connection with the production of filaments from man-made fiber forming materials, it has been common to utilize spinnerets including a plurality of exit passageways in the form of nozzles or orifices machined in a spinneret plate. A liquid comprising a polymer melt or a solution of a polymer in an appropriate solvent is extruded through these nozzles in the filament forming process.

As will be appreciated, the profile of such spinneret nozzles has been the subject of considerable efforts. In this connection, reference may be had to U.S. Pat. No. 3,537,135 (issued Nov. 3, 1970), U.S. Pat. No. 3,303,530 (issued Feb. 14, 1967), U.S. Pat. No. 3,210,451 (issued Oct. 5, 1965), U.S. Pat. No. 3,227,009 (issued Jan. 4, 1966), and U.S. Pat. No. 3,174,183 (issued Mar. 3, 1965) for disclosures of spinnerets with exit passageways having a variety of profiles.

An important consideration in fluid flow through a spinneret passageway of any given profile is that of fluid pressure drop. The pressure drop across a spinneret can be expressed as the sum of the viscous dissipation in the passageway and the entrance and exit flows, the pressure drop due to kinetic energy effects, and that due to storage of elastic energy.

Another important consideration in spinneret fluid flow is that of extrudate swell or die swell, i.e. the ratio of the fiber cross-sectional area after it passes the exit orifice of the spinneret exit passageway to the cross-sectional area of that exit orifice. Die swell has a direct effect on draw ratios and fiber elongation.

For example, in the case of spinning polyethylene terephthalate (PET), increased extrudate swell resulting from increased spinning productivity would produce decreases in after-draw ratio. Similarly, in connection with production of dry spun fibers from cellulose triacetate (CTA), increased extradate swell would reduce fiber elongation.

It has been found that extrudate swell in connection with flow through a capillary is inversely related to the ratio of the capillary length to its diameter. However, under high spinning productivities, attempts to reduce extrudate swell by increasing that ratio may produce an excessive pressure drop due to viscous dissipation.

Since costs associated with the operation of spinning equipment are considerable, adequately high spinning productivity must be maintained.

It would, therefore, be highly desirable to provide a novel spinning apparatus based upon a passageway profile designed to advantageously accomodate desirable spinning productivity consistent with acceptable pressure drop and extrudate swell. Accordingly, it is a general object of the present invention to provide such a novel spinning apparatus.

In spinning operations, one important viscosity consideration is that of fluid pressure drop in spinneret flow due to viscous dissipation. Under high productivity spinning conditions, viscous pressure drop often becomes excessive. As such, viscous pressure drop to some extent constitutes a limiting factor on spinning productivity. Since the costs associated with the operation of spinning equipment are considerable, it would be highly desirable to provide for increased spinning productivity by minimizing viscous pressure drop or to provide for a viscous pressure drop consistent with a given spinning productivity.

In realizing this object, the present invention departs from those prior art approaches to design of spinneret nozzle profiles which have been governed primarily by direct viscosity considerations, and perhaps, to some extent, inertial and turbulence considerations.

In this connection, the present invention embodies a recognition that spinneret flow for fluids generally classified as "viscous", such as PET melts or CTA solutions, is dominated by "elastic" forces. More particularly, according to the present invention a nozzle profile is provided so as to establish an essentially constant extensional strain rate, viz. a constant change in velocity with respect to the incremental distance of fluid travel (an elastic force consideration). In this fashion the flow condition for the liquid is such as to provide for a low total pressure drop. At the same time adequate spinning speeds may be employed with acceptable die swell.

The essentially constant extensional strain rate leads to a low total pressure drop through several mechanisms. First, since the elastic pressure drop contribution to the total pressure drop is governed by the maximum extensional strain rate, a low constant extensional strain rate may be chosen to reduce that contribution as compared with prior art nozzle profiles. Secondly, as hereinafter more fully described, at a chosen constant extensional strain rate, the viscous pressure drop is minimized. In addition, the gentle streamline entry flow provided by the nozzle profile of the present invention is believed to reduce dissipation due to vena contracta type eddies.

It may be here noted that an apparently similar profile has been proposed for an entirely different purpose, namely, the design of a minimum length die to be used for extruding on a wire, plastics which are subject to melt fracture. (See Ferrari U.S. Pat. No. 3,382,535, issued May 14, 1968.) Considerations directed toward elimination of melt fracture and minimizing die length in the environment of extruding plastics on a wire are unrelated to the present invention, in that polymers involved in the contemplated spinning operations do not exhibit any significant melt fracture in the range of operating conditions selected in contemplation for practice of the present invention.

Consistent with the foregoing, it is, therefore, a further object of the present invention to provide a novel spinning apparatus wherein an essentially constant extensional strain rate is established for flow through a spinneret nozzle.

It is a further object of the present invention to provide such a novel spinning apparatus wherein adequate spinning speeds may be employed with acceptable die swell.

It is yet another object of the present invention to provide such a novel spinning apparatus wherein a low total pressure drop is produced.

It is still another object of the present invention to provide such a novel spinning apparatus which minimizes breaking of filaments in a spin line, and thus minimizes the occurence of incomplete packages. In this connection, it is believed that breaking of filaments in a spin line might, in some respects, be attributable to faults or impurities, in the spinning material. The particular improved spinneret flow produced according to the present invention is thought to minimize the adverse consequences attributable to such faults or impurities.

SUMMARY OF PREFERRED EMBODIMENTS OF THE INVENTION

A preferred form of the invention intended to accomplish at least some of the foregoing objects entails the spinning of fibers through the provision of a spinneret plate for extruding polymeric materials and including at least one converging extrusion passageway having an entry opening and an exit orifice, with the passage profile being designed to establish an essentially constant extensional strain rate.

Spinning speeds in the range of about 500 to 1500 meters per minute in the case of solution spinning and 500 to 6000 meters per minute in the case of melt spinning are usually appropriate, with about 1000 meters per minute and about 1200 to 3000 meters per minute being preferred respectively for dry and wet solution and for melt spinning. Solution spinning temperatures of about 50° to 110° C, preferably about 90° C are usually contemplated. For melt spinning, temperatures in the range of about 275° to 330° C, preferably 285° to 300° C, are involved.

Preferably the approach angle, defined as the angle of intersection between the axis of the converging extrusion passageway and the tangent to the wall of that passageway at the entrance opening, is between about 15° to 45°.

The passageway (i.e. the spinneret plate thickness) and exit orifice area may vary, with lengths in the range of about 0.020 to 0.060 inches for solution spinning and 0.1 to 0.6 inches for melt spinning, and areas in the range of about $3 \times 10^{-6}$ to $50 \times 10^{-6}$ square centimeters (solution spinning) and about $1 \times 10^{-4}$ to $50 \times 10^{-4}$ square centimeters (melt spinning) being desirable.

In accordance with the present invention, it will be appreciated that spinning of fiber-forming materials by solution spinning (wet or dry) or melt spinning (without significant melt fracture in the range of operating conditions selected for the materials in contemplation for practice of the present invention) of any suitable polymeric materials, such as polyamides, polyesters, acrylics, polyimides, cellulosics, vinyl chloride and vinylidene cyanide polymerics and the like, may be practiced. Particular applicability of the present invention may be found in high speed spinning of cellulose esters or polyesters, especially polyethelene terephthalate.

For example, the process is of particular value in the dry solution spinning of cellulose triacetate from solution in a solvent comprising a major amount of a halogenated hydrocarbon such as methylene chloride.

In this connection, as employed herein, cellulose triacetate has reference to cellulose acetate having fewer than about 0.29 and preferably fewer than about 0.12 free hydroxyl group per anhydroglucose unit of the cellulose molecule, i.e., an acetyl value calculated as combined acetic acid by weight of at least about 59 percent and preferably at least about 61 percent.

Advantageously, its intrinsic viscosity ranges from about 1.5 to 2.5 and is preferably about 2, and it is present in the dope to a concentration ranging from about 20 to 25 percent. In place of methylene chloride, the dope solvent may comprise other halogenated lower alkanes such as ethylene dichloride or propylene chloride. Preferably, up to about 15 percent by weight of the dope solvent comprises a lower alkanol such as methanol, ethanol, isopropanol, etc. The preferred dope solvent is methylene chloride-methanol in the proportions of about 90–10 by weight.

The cross-sectional configuration of the nozzle employed in accordance with the present invention is preferably symmetrical about the nozzle axis, with a circular cross-section being the preferred form. However, non-circular configurations conventional in the spinning art, such as for example those depicted in U.S. Pat. No. 3,303,530, issued Feb. 14, 1967, are also contemplated.

Other objects and advantages of the present invention will become apparent from the following detailed description thereof with reference to the accompanying drawings in which like numerals indicate like elements, and in which:

THE DRAWINGS

DETAILED DESCRIPTION

Figure 1:
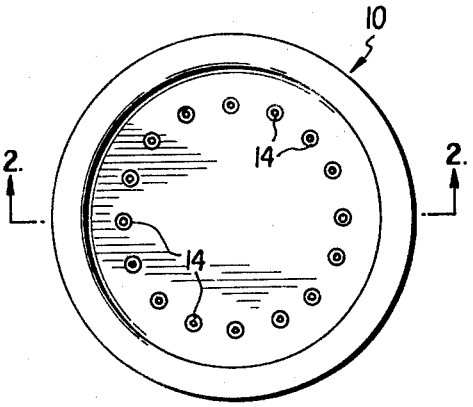
FIG. 1 is a plan view of a spinneret in accordance with the present invention.

With reference now to FIG. 1, a spinneret or jet 10 in accordance with the present invention may be seen. This spinneret is made of any suitable material such as stainless steel.

Figure 2:
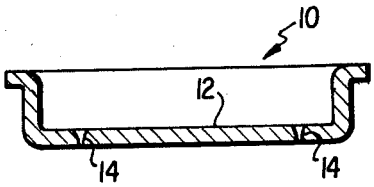
FIG. 2 is a sectional view taken along line 2—2 of FIG. 1.

As may be seen in FIG. 2, the spinneret is generally cup-shaped. The cup bottom indicated at 12 is provided with a plurality of circumferentially disposed, spaced apertures or exit passageways 14 therethrough.

During spinning operations, a liquid comprising a polymer melt or a solution of a polymer in an appropriate solvent is supplied to the spinneret 10 and is extruded through the exit passageways 14 in the filament forming process. An enlarged view of a preferred forms of the exit passageway 14 may be seen in FIGS. 3 and 4.

Each passageway 14 is in the form of a converging nozzle, the profile of which is hereinafter more fully described, that terminates in an exit orifice 16. After flow into the entry orifice 17, through the nozzle passageway and out the exit orifice 16, elastic energy stored in the liquid is recovered so as to result in extrudate swell or die swell. This storage of elastic energy occurs by reason of the extensional flow of the fluid.

Figure 5:
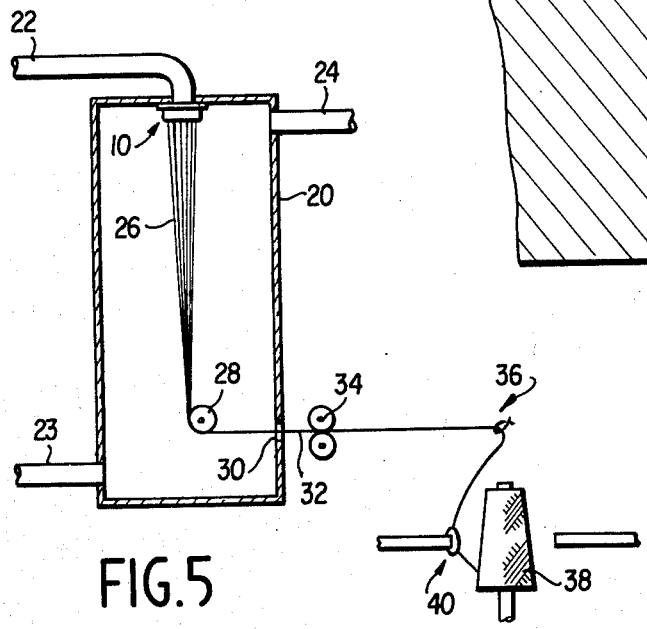
FIG. 5 is a schematic illustration of a dry spinning operation in accordance with the present invention.

In FIG. 5 there is shown a dry spinning cabinet 20 to which dope is supplied through a pipe 22. The liquid dope is extruded through the spinneret 10 of FIGS. 1–3 with no intervening plating of the spinneret. Hot air may be admitted to the cabinet 20 through a suitable conduit 23 and may be exhausted through a suitable conduit 24 along with vapors of the dope solvent. The filaments 26 leaving the spinneret 10 through the extrusion passageways 14 are directed about a guide 28 and out of the cabinet at a location indicated at 30. The filaments are pulled as a yarn 32 by suitable draw rolls 34. The yarn 32 by suitable draw rolls 34. The yarn 32 passes through a guide 36 and is twisted and taken up on a bobbin 38 by a conventional collector such as a ring spinner 40.

Figure 3:
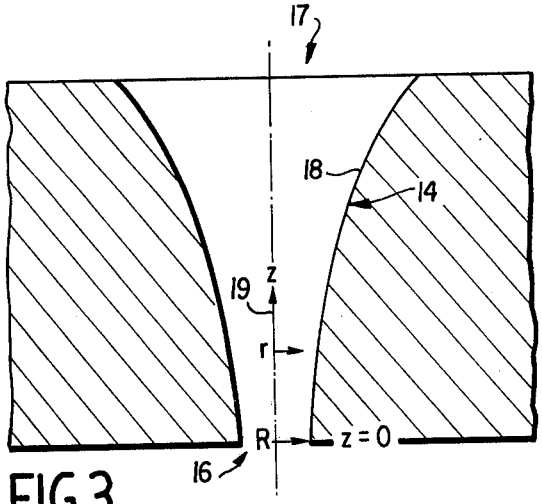
FIG. 3 is an enlarged sectional view showing the profile of the exit passageway of the spinneret of FIGS. 1 and 2.

With renewed reference to FIG. 3, the nozzle profile in accordance with the present invention may be more fully appreciated. In FIG. 3, the radius of the exit orifice 16 is indicated by R. The nozzle preferably is circular in transverse cross-section, and has smooth, gradually curving walls 18 in the form of a surface of revolution defined by a generatrix moving about the central axis 19 of the passageway 14. The wall profile, conforming to the shape of this generatrix, provides an essentially constant extensional strain rate during flow of the polymeric material through the passageway 14 by being designed to essentially respond to the following cubic equation:

$$1/r_w^2 = AZ + 1/R^2 \quad (1)$$

where:

$R$ is the radius of the exit orifice 16;

$r_w$ is the wall radius measured perpendiclar to the axis 19;

$Z$ is the distance along the axis 19 of the nozzle measured from the exit orifice 16; and $A$ is a constant hereinafter more fully described.

Once the criterion of constant extensional strain rate is selected, the foregoing Equation (1) may be derived by integrating the following equation:

$$\delta V/\delta Z = K \quad (2)$$

where:

$\delta V/\delta Z$ is the extensional strain rate represented by the partial derivative of velocity (V) with respect to distance measured from the exit orifice 16 along the nozzle axis 19; and $K$ is a constant, while recalling that:

$$V = Q/hr_w^2 \quad (3)$$

where:

$V$ is the fluid velocity;

$r_w$ is the wall radius as defined for equation (1); and $Q$ is the volumetric flow rate.

and while also recalling the limit condition that $r_w$ is equal to R [as defined for equation (1)] at the exit orifice 16.

Preferably the constant A of Equation (1) is determined by equating the constant extensional strain rate K of Equation (2) with the maximum extension strain rate for a conical spinneret wherein the die swell is acceptable (hereinafter referred to as "equivalent conical spinneret"). Then, $$K = \delta V/\delta Z \text{ max. cone} \quad (4)$$

where:

$\delta V/\delta Z$ max. cone is the maximum extensional strain rate for the equivalent conical spinneret.

The well known equation for the wall profile of a conical spinneret is:

$$r_w = Z \tan \theta \quad (5)$$

where:

$r_w$ and $Z$ are as defined in Equation (1); and $\theta$ is the half angle of the equivalent conical spinneret, preferably in the range of 2 to 7½ degrees.

By combining equations (3) and (5), and recognizing that for a cone $\delta V/\delta Z$ is a maximum at the exit orifice 16 where $Z$ is zero and $r_w$ is R, it will be determined that:

$$\frac{dv}{dz} \text{ max. cone} = \frac{-\tan \theta}{2} \dot{\gamma}_R \quad (6)$$

where:

$\dot{\gamma}_R$ is $4Q/\pi R^3$, the wall shear rate.

Equations (2) through (6) may then be combined and integrated to produce equation (1) where A of equation (1) will be defined as:

$$A = \frac{-2 \tan \theta}{R^3} \quad (7)$$

To determine the numerical values for the nozzle profile in accordance with Equation (1), one need only select a value $\theta$ for the equivalent conical spinneret with an acceptable die swell and the desired value R, the radius of the exit orifice 16.

It will also be appreciated that the profile for the walls 18 of the passageway 14 provides for minimizing the viscous pressure drop. This will be realized through approximating the flow through the nozzle as a series of telescoping capillaries, and assuming that the polymer viscous flow may be described by a power law:

$$\tau\omega = K_1 \left( \frac{3n+1}{4n} \; \frac{4Q}{\pi\gamma\omega^3} \right)^n \quad (8)$$

where:

$\tau_w$ is the wall sheer stress; and $K$, and $n$ are fluid constants,

Describing the viscous pressure drop $\Delta$ P $v$ as:

$$\Delta Pv = \int_{z=0}^{z=z^\infty} \frac{2\tau\omega}{\sqrt{\omega}} dz \quad (9)$$

where:

$Z$ indicates the axial position where $r_w$ becomes infinite and combining Equations (8) and (9) yields:

$$\Delta Pv = 2K_1 \left( \frac{3n+1}{n} \; \frac{Q}{\pi} \right)^n \int_0^{z^\infty} \frac{dz}{\sqrt{\omega}} \; 3n+1 \quad (10)$$

When equation (3) is partially differentiated with respect to Z to produce:

$$\frac{dv}{dz} = \frac{-2Q}{\pi} \frac{1}{\gamma\omega^3} \frac{d\gamma\omega}{dz} \quad (11)$$

and Equation (11) is rearranged and substituted in Equation (10), it will be seen that $$\Delta Pv = \frac{-4K_1Q}{\pi} \left(\frac{3n+1}{n} \frac{Q}{\pi}\right)^n \int_{\gamma\omega = R}^{\gamma\omega = \infty} \frac{d\gamma\omega}{(dv/dz)\gamma\omega} 3n + 4 \quad (12)$$

Since $\delta V/\delta Z$ appears in the denominator of Equation (12), the largest possible value of $\delta V/\delta Z$ provides the smallest viscous pressure drop ($\Delta Pv$). However, the provision for a constant extensional strain rate inherently imposes the constraint that:

$$\delta V/\delta Z \leq \delta V/\delta Z \text{ maximum}, \quad (13)$$

leading to the conclusion that the viscous pressure drop of Equation (12) is minimized by the extensional strain rate being at a constant that is also the maximum.

Figure 4:
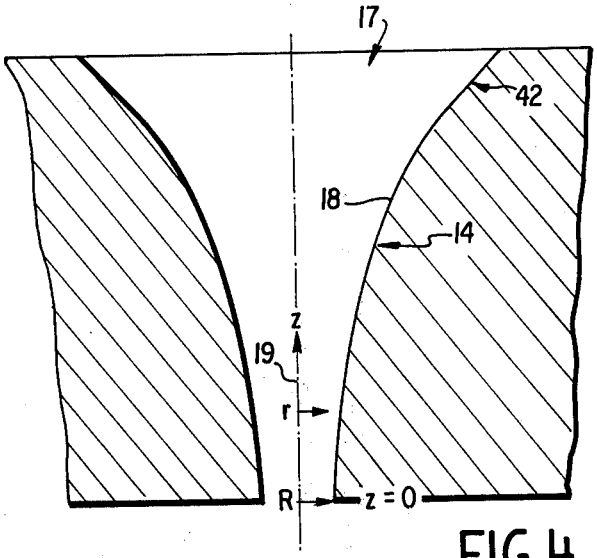
FIG. 4 is an enlarged sectional view showing the passageway of FIG. 3 contiguous, adjacent its entry end, with a frusto-conical passageway.

With reference now to FIG. 4, a further nozzle passageway that may be employed according to the present invention may be seen. The passageway of FIG. 4 is comprised of the nozzle passage 14 of FIG. 3 contiguous with a passageway extension 42 in the form of a frusto-conical countersink. It has been found that manufacturing of the spinneret with a passageway 14 profile establishing an essentially constant extensional strain rate as discussed above is more convenient when such a countersink is provided.

To aid in insuring a smooth flow transition, it is, however, desirable that the intersection of the conical section 42 with the passageway 14 be such that the walls of the cone are tangent to the walls 18 of the passageway 14 at its entry orifice 17. If such tangency is not provided, and the cone makes a steeper angle than the tangent then the extensional strain rate in the conical section 42 will be greater. As such, the chosen die-swell characteristics will not be met, and viscous pressure drop will be greater than the minimum which the constant extensional strain rate otherwise would provide.

Although the invention has been described with reference to preferred forms thereof, it will be appreciated that additions, subsitutions, modifications and deletions may be made without departing from the spirit and scope of the invention as defined in the appended claims:

What is claimed is:

1. In apparatus for spinning filaments from fiber-forming, liquid polymeric material which apparatus includes a spinneret for extending said material through at least one converging nozzle passagway having an entry opening, and an exit orifice with a cross-sectional area in the range of about $3 \times 10^{-6}$ to $50 \times 10^{-4}$ square centimeters, the improvement wherein said nozzle passageway is bounded by gradually curving walls having a profile shaped to provide an essentially constant extensional strain rate on liquid polymeric material extruded therethrough to form a filament solely of that material, said profile being described essentially by the equation $$\frac{1}{\gamma_w 2} = AZ + \frac{1}{R^2}$$

where:

$R$ is the perpendicular distance between an axis of the passageway axis and the nozzle wall at the exit orifice;

$r_w$ is the perpendicular distance between nozzle wall and point along that axis;

$Z$ is the distance along that axis measured from said exit orifice; and $A$ is a constant.

2. The apparatus according to claim 1 wherein said profile is defined by a surface of revolution defined by a generatrix described by said equation and moving about said axis in a generally circular path.

3. The apparatus according to claim 2 wherein the constant A in said equation is defined by $$\frac{-2 \tan \theta}{R^3}$$

where $\theta$ is the conical half angle of an equivalent frusto-conical passageway for establishing a maximum extensional strain rate essentially equal to said essentially constant extensional strain rate.

4. The apparatus according to claim 1 wherein said passageway is contiguous with and tangent to the walls of a frusto-conical passageway.

5. The apparatus according to claim 4 wherein the angle of intersection between the axis of said converging passageway and said walls of said passageway is between about 15° to 45°.

6. The apparatus according to claim 1 wherein the length of said passageway is in the range of about 0.020 to 0.060 inches.

7. The apparatus according to claim 1 wherein the length of said passageway is in the range of about 0.1 to 0.6 inches.

8. The apparatus according to claim 1 wherein the cross-sectional area of the exit orifice of said passageway is in the range of about $3 \times 10^{-6}$ to $50 \times 10^{-6}$ square centimeters.

9. The apparatus according to claim 1 wherein the cross-sectional area of the exit orifice of said passageway is in the range of about $1 \times 10^{-4}$ to $50 \times 10^{-4}$ square centimeters.

10. The apparatus according to claim 1 wherein the length of said passageway is in the range of about 0.020 to 0.060 inches and wherein the cross-sectional area of the exit orifice of said passageway is in the range of about $3 \times 10^{-6}$ to $50 \times 10^{-6}$ square centimeters.

11. The apparatus according to claim 1 wherein the length of said passageway is in the range of about 0.1 to 0.6 inches and wherein the cross-sectional area of the exit orifice of said passageway is in the range of about $1 \times 10^{-4}$ to $50 \times 10^{-4}$ square centimeters.

12. The apparatus according to claim 1 wherein the length of nozzle passageway is in the range of about 0.020 to 0.6 inches.

13. Apparatus for forming yarn from liquid polymeric material comprising:

a spinneret for extruding the material through a plurality of converging nozzle passageways each having an entry opening, and an exit orifice with a cross-sectional area in the range of about $3 \times 10^{-6}$ to $50 \times 10^{-4}$ square centimeters;

each passageway being bounded by gradually curving walls having a profile shaped to provide essentially constant extensional strain rate on liquid polymeric material extruded therethrough to form a filament solely of that material, said profile being described essentially by the equation $$\frac{1}{\gamma_w 2} = AZ + \frac{1}{R^2}$$

where:

$R$ is the perpendicular distance between an axis of the passageway and the nozzle wall at the exit orifice;

$r_w$ is the perpendicular distance between the nozzle wall and points along that axis;

$Z$ is the distance along that axis measured from said exit orifice; and $A$ is a constant;

a guide roll; and draws rolls for pulling filaments from a plurality of the nozzles of the spinneret over said guide roll as yarn.

* * * * *

UNITED STATES PATENT AND TRADEMARK OFFICE

CERTIFICATE OF CORRECTION

PATENT NO. : 4,015,924

DATED : April 5, 1977

INVENTOR(S) : Herman L. LaNieve

It is certified that error appears in the above-identified patent and that said Letters Patent are hereby corrected as shown below:

In the Abstract, the formula should read:

$$\frac{1}{r_\omega^2} = AZ + \frac{1}{R^2} .$$

Column 5, lines 29-30, equation (1) should read:

$$\frac{1}{r_\omega^2} = AZ + \frac{1}{R^2} ;$$

lines 41-44, equation (2) should read:

$$\frac{\partial V}{\partial Z} = K ;$$

line 46, "$\delta V/\delta Z$" should read -- $\partial V/\partial Z$ --; lines 52-54, equation (3) should read:

$$V = \frac{Q}{\pi r_\omega^2} ; \text{ and}$$

lines 67-70, equation (4) should read:

$$K = \left.\frac{\partial r}{\partial Z}\right|_{\text{max. cone}} .$$

UNITED STATES PATENT AND TRADEMARK OFFICE

CERTIFICATE OF CORRECTION

PATENT NO. : 4,015,924

DATED : April 5, 1977

INVENTOR(S) : Herman L. LaNieve

It is certified that error appears in the above-identified patent and that said Letters Patent are hereby corrected as shown below:

Column 6, line 3 and line 15 "$\delta V/\delta Z$" should read -- $\partial V/\partial Z$ --; lines 18-22, equation (6) should read:

$$\left.\frac{\partial r}{\partial Z}\right|_{\text{max. cone}} = -\frac{\tan\theta}{2} \quad \dot{\gamma}_R \quad ;$$

lines 44-48, equation (8) should read:

$$\tau_\omega = K_1 \left(\frac{3n+1}{4n} \quad \frac{4Q}{\pi r_\omega^3}\right)^n \quad ;$$

line 50, "sheer" should read -- shear --; line 52, "$\Delta P\nu$" should read -- $\Delta P_\nu$ --; and lines 53-57, equation (9) should read:

$$\Delta P_\nu = \int_{Z=0}^{Z=Z_\infty} \frac{2\tau_\omega}{r_\omega}\, dZ \quad .$$

Column 7, lines 1-4, equation (11) should read:

$$\frac{\partial V}{\partial Z} = \frac{-2Q}{\pi} \quad \frac{1}{r_\omega^3} \quad \frac{\partial r_\omega}{\partial Z} \quad ;$$

UNITED STATES PATENT AND TRADEMARK OFFICE

CERTIFICATE OF CORRECTION

PATENT NO. : 4,015,924

DATED : April 5, 1977

INVENTOR(S) : Herman L. LaNieve

It is certified that error appears in the above-identified patent and that said Letters Patent are hereby corrected as shown below:

lines 7-15, equation (12) should read:

$$\Delta P_\nu = \frac{-4K_1 Q}{\pi} \left(\frac{3n+1}{n} \frac{Q}{\pi}\right)^n \int_{r_\omega = R}^{r_\omega = \infty} \frac{dr_\omega}{\left(\frac{\partial V}{\partial Z}\right) r_\omega^{3n+4}} \quad ;$$

lines 16 and 17, "$\delta V/\delta Z$" should read -- $\partial V/\partial Z$ --; line 18, "$\Delta P\nu$" should read -- $\Delta P_\nu$ --; and lines 21-23, equation (13) should read:

$$\frac{\partial V}{\partial Z} \leq \left.\frac{\partial V}{\partial Z}\right|_{\text{maximum}} \quad .$$

Claim 1, line 14, the equation should read:

$$\frac{1}{r_\omega^2} = AZ + \frac{1}{R^2} \quad .$$

UNITED STATES PATENT AND TRADEMARK OFFICE

CERTIFICATE OF CORRECTION

PATENT NO. : 4,015,924

DATED : April 5, 1977

INVENTOR(S) : Herman L. LaNieve

It is certified that error appears in the above-identified patent and that said Letters Patent are hereby corrected as shown below:

Claim 13, line 14, the equation should read:

$$\frac{1}{r_\omega^2} = AZ + \frac{1}{R^2} \quad .$$

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*